US011251523B2

(12) United States Patent
Kassouf et al.

(10) Patent No.: US 11,251,523 B2
(45) Date of Patent: Feb. 15, 2022

(54) ACTIVE ARRAY SYSTEMS UTILIZING A THINNED ARRAY

(71) Applicant: ST TECHNOLOGIES LLC, Hermosa Beach, CA (US)

(72) Inventors: Philippe Kassouf, Culver City, CA (US); Long Bui, Rolling Hills Estates, CA (US); Jeb Binkley, Portland, OR (US)

(73) Assignee: ST TECHNOLOGIES LLC, Hermosa Beach, CA (US)

( * ) Notice: Subject to any disclaimer, the term of this patent is extended or adjusted under 35 U.S.C. 154(b) by 127 days.

(21) Appl. No.: 16/844,568

(22) Filed: Apr. 9, 2020

(65) Prior Publication Data

US 2020/0328510 A1 Oct. 15, 2020

Related U.S. Application Data

(60) Provisional application No. 62/831,553, filed on Apr. 9, 2019.

(51) Int. Cl.

| | |
|---|---|
| ***H01Q 3/26*** | (2006.01) |
| ***H01Q 3/01*** | (2006.01) |
| ***H01Q 21/00*** | (2006.01) |

(52) U.S. Cl.

CPC ..... *H01Q 3/2611* (2013.01); *H01Q 3/01* (2013.01); *H01Q 21/0025* (2013.01)

(58) Field of Classification Search

CPC .... H01Q 3/2611; H01Q 3/01; H01Q 21/0025; H01Q 21/22; H01Q 21/06; H01Q 21/061; H01Q 21/08

See application file for complete search history.

(56) References Cited

U.S. PATENT DOCUMENTS

| | | | | |
|---|---|---|---|---|
| 5,537,367 | A | 7/1996 | Lockwood et al. | |
| 2012/0201097 | A1 | 8/2012 | Fox | |
| 2013/0162475 | A1* | 6/2013 | Blech | H01Q 21/28 342/368 |

(Continued)

FOREIGN PATENT DOCUMENTS

| | | | | |
|---|---|---|---|---|
| CA | 2623401 C | * | 4/2014 | G01S 13/89 |
| CN | 104215958 B | * | 6/2017 | H01Q 3/2635 |

(Continued)

OTHER PUBLICATIONS

International Search Report and Written Opinion from the International Searching Authority, dated Jul. 9, 2020, 7 pages, for corresponding International Patent Application No. PCT/US2020/027519.

*Primary Examiner* — Seokjin Kim

(74) *Attorney, Agent, or Firm* — Benjamin B. Matthew, Esq.; Polsinelli

(57) ABSTRACT

Aspects of the disclosed technology relate to an active array system that can form and steer a directed beam across its aperture. The disclosed array system utilizes a novel configuration that significantly reduces a number of transmit and receive elements. In some aspects, the disclosed array system can be configured with a modular design, for example, to permit the extension of the transmit/receive array, e.g., to increase/decrease aperture size. In other aspects, the disclosed array system may be configured to dispose the elements of either the first or second group of radiators in a modular fashion.

20 Claims, 8 Drawing Sheets

(56) References Cited

U.S. PATENT DOCUMENTS

| | | | | |
|---|---|---|---|---|
| 2014/0340253 | A1* | 11/2014 | Koerber | G01S 13/58 342/104 |
| 2016/0025839 | A1* | 1/2016 | Trummer | H01Q 13/065 342/109 |
| 2017/0209121 | A1 | 6/2017 | Davis, Sr. et al. | |
| 2017/0324162 | A1* | 11/2017 | Khachaturian | H01Q 21/065 |
| 2020/0328510 | A1* | 10/2020 | Kassouf | H01Q 3/2611 |
| 2021/0215817 | A1* | 7/2021 | Lee | G01S 13/44 |

FOREIGN PATENT DOCUMENTS

| | | | | |
|---|---|---|---|---|
| EP | 2315312 | A1 * | 4/2011 | H01Q 21/06 |
| WO | WO 2007/063298 | | 6/2007 | |
| WO | WO-2010000254 | A2 * | 1/2010 | G01S 13/4454 |
| WO | WO-2015010760 | A1 * | 1/2015 | H01Q 21/061 |
| WO | WO 2017/218876 | | 12/2017 | |
| WO | WO-2020049562 | A1 * | 3/2020 | G01S 7/03 |

* cited by examiner

ACTIVE ARRAY SYSTEMS UTILIZING A THINNED ARRAY

CROSS-REFERENCE TO RELATED APPLICATIONS

This application claims the benefit of U.S. Application No. 62/831,553, filed Apr. 9, 2019, entitled "ACTIVE ARRAY SYSTEM UTILIZING A THINNED ARRAY", which is incorporated by reference in its entirety.

FIELD

The present invention generally relates to array systems such as phased array systems, and more particularly to active array systems that utilize a thinned array.

SUMMARY

According to various aspects of the subject technology, an active array system utilizing an array thinning methodology is provided.

It is understood that other configurations of the subject technology will be readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

Figure 1:
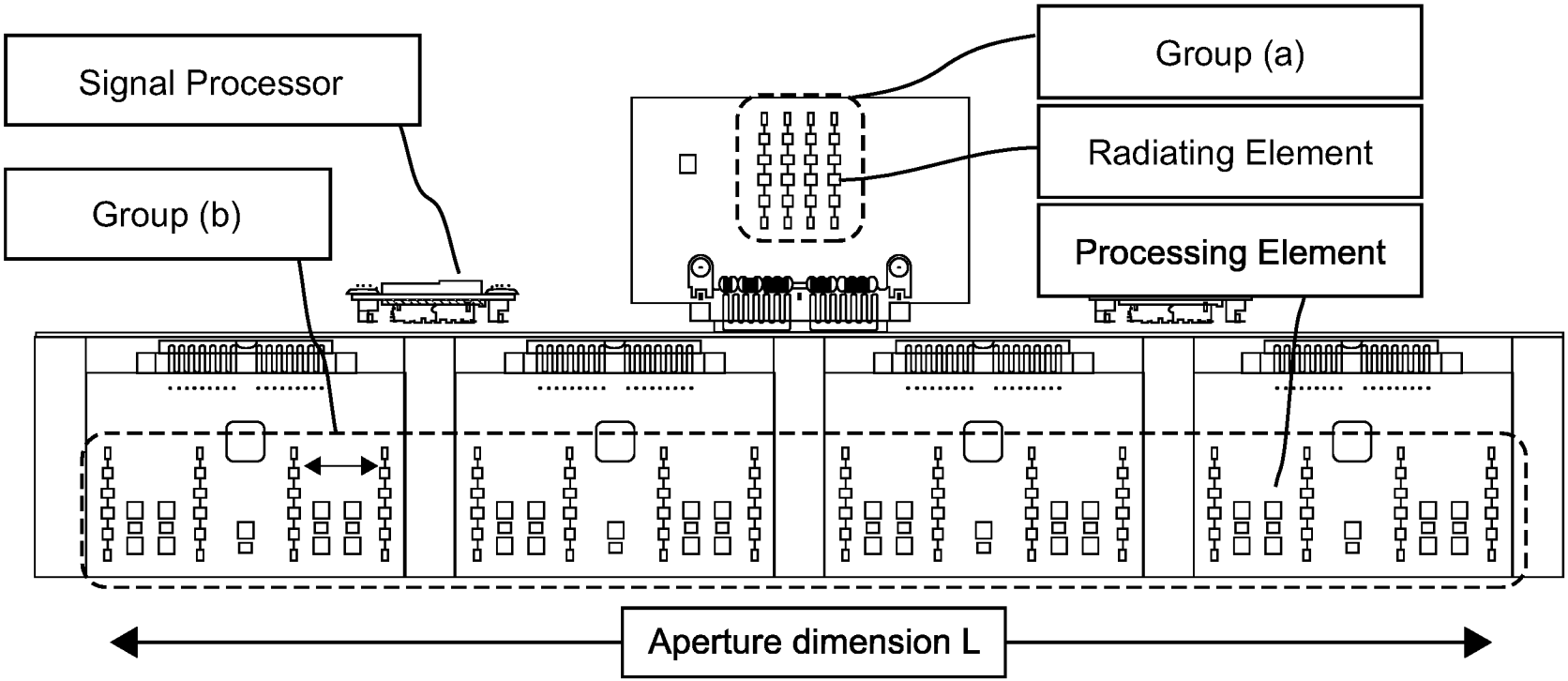
FIG. 1 illustrates perspective view of an implementation of a thinned-array that can be implemented in an active array system, according to some aspects of the technology.

In the following detailed description, numerous specific details are set forth to provide a full understanding of the subject technology. It will be apparent, however, to one ordinarily skilled in the art, that the subject technology can be practiced without some of these specific details. In other instances, well-known structures and techniques have not been shown in detail so as not to obscure the subject technology.

Conventional array systems require transmit and receive elements to be spaced at close proximity, within approximately a half wavelength (λ), thereby necessitating a large number of elements for applications requiring larger apertures, such as in phased array radar, sonar and Light Detection and Ranging (LiDAR) systems. In addition, conventional imaging systems may utilize a motor and encoder to position and sweep the aperture (containing the transmit/receive elements) through a series of positions at a rate of about 15 frames per second, or less. Use of the motor and other mechanical components necessarily introduces mechanical slop or tolerances to the imaging systems, thereby limiting their spatial resolution. Moreover, because of the mechanical limitations of the motor and associated components, such systems cannot exceed a sweeping rate that exceeds 15 frames per second. The temporal resolution of the resulting images is limited due to the relatively low frame rate of such motor driven systems.

Generally, the higher the frequency band utilized by an imaging system, the better the spatial resolution. As frequency increases, wavelength decreases. Because of the half wavelength spacing and one-to-one nature in conventional transmit and receive element configurations, use of higher frequencies (e.g., above 10 GHz) in certain array systems is not possible due to the increase in density of transmit and receive elements. In addition, such systems require significant data processing capabilities to process data for each of the transmit/receive elements. Such extensive processing requires a significant supply of power that, when coupled with the increased weight and size of necessary power systems, may further render such systems impractical for certain uses, such as in aeronautical applications. Accordingly, there is a need for active array systems that can operate at higher frequencies, with larger apertures, which provides higher resolution images, without the need of hundreds of transmit/receive elements, extensive processing, high power, mechanical components, and that can be packaged in form factors that enable deployment in a wide array of applications.

Overview:

The disclosed technology addresses the foregoing limitations by providing an active array system that can form and steer a directed beam across its aperture without the use of hundreds of elements and mechanical components such as a motor, as well as a complex signal processor for facilitating the beam steering and generation of high-resolution output images. As discussed in further detail below, the disclosed array system utilizes a novel thinned-array configuration that significantly reduces the number of transmit and receive elements and associated processing and power requirements. In one aspect, because of the reduced number of elements, as well as reduced processing and power requirements, the disclosed array system may be packaged in an efficient form factor that enables such systems to be utilized in a many applications. Additionally, in some aspects, the disclosed array system can be configured with a modular design, for example, to permit the extension of the transmit/receive array, e.g., to increase/decrease aperture size when needed.

In one aspect, the reduction of transmit and receive elements provides several important benefits over conventional array systems that require a fixed half wavelength spacing of transmit/receive elements within the array and or a one-to-one correspondence of elements. For example, the thinned array of the disclosed technology provides significant cost benefits by reducing element count and simplifying manufacturing, while also enabling the realization of efficient and compact transmit/receive structures suitable for multiple applications, including but not limited to general aviation, drone applications, robotics, telecommunications, automotive, medical, maritime, artificial intelligence (AI), industrial, border patrol, asset tracking, security, monitoring and/or urban mobility markets, etc. The disclosed array system may be configured to detect wind shear, doppler, weather, objects, obstacles, etc. and to represent the detected information in an image.

In contrast to conventional approaches, the disclosed technology is both deterministic and periodic in structure and synthesizes an array that can cover an arbitrary aperture with a given radiation pattern (i.e., it permits modularity).

As discussed in further detail below, the novel placement/spacing of transmit/receive elements allows for a minimal number of elements to span a given aperture length, and is rooted in the deterministic and periodic (as opposed to random thinning) formation of orthogonal side lobes between each group. Received signal data is then provided to a signal processor (including various hardware and software modules) that is utilized to cause interference, nulling out all but a desired, directed and steerable, main lobe.

Array Configuration:

The disclosed subject matter describes systems and methods for generating an image using an active array system that utilizes a reduced number of transmit and receive elements. The array system comprises a set of transmit elements arranged in a first array and a set of receive elements arranged in a second array. Each of the set of transmit and receive elements can be disposed on integrated printed circuit boards ("PCBs") that can include one or more processors for performing signal and/or video processing of the signal data received by the receive elements.

In one aspect of the subject technology, receive elements can be spaced apart at a distance that is greater than half a wavelength of the transmit signal, thereby allowing for a significant reduction in a number of receive elements, when compared to conventional systems. As discussed below, spacing of the receive elements can be determined by considering a reduction or thinning factor and multiplying that factor by half of the wavelength utilized by the transmit elements. As such, the array of receive elements can be reduced by the reduction or thinning factor, as desired.

For example, for a reduction or thinning factor of 2, two transmit elements may be spaced at approximately ½λ, and the receive elements may be spaced apart by 2×(½λ), thereby allowing a reduction of receive elements by a factor of 2 over conventional systems that require receive elements to be spaced apart at a distance of half a wavelength. For a reduction or thinning factor of 3, three transmit elements may be spaced at approximately ½λ, and the receive elements may be spaced apart by 3×(½λ) thereby allowing a reduction of receive elements by a factor of 3 over conventional systems that require receive elements to be spaced apart at a distance of half a wavelength. For a reduction or thinning factor of 4, four transmit elements may be spaced at approximately ½λ, and the receive elements may be spaced apart by 4×(½λ) thereby allowing a reduction of receive elements by a factor of 4 over conventional systems that require receive elements to be spaced apart at a distance of half a wavelength. For a reduction or thinning factor of 5, five transmit elements may be spaced at approximately ½λ, and the receive elements may be spaced apart by 5×(½λ) thereby allowing a reduction of receive elements by a factor of 5 over conventional systems that require receive elements to be spaced apart at a distance of half a wavelength.

For a reduction or thinning factor of 6, six transmit elements may be spaced at approximately ½λ, and the receive elements may be spaced apart by 6×(½λ) thereby allowing a reduction of receive elements by a factor of 6 over conventional systems that require receive elements to be spaced apart at a distance of half a wavelength. For a reduction or thinning factor of 7, seven transmit elements may be spaced at approximately ½λ, and the receive elements may be spaced apart by 7×(½λ) thereby allowing a reduction of receive elements by a factor of 7 over conventional systems that require receive elements to be spaced apart at a distance of half a wavelength. For a reduction or thinning factor of 8, eight transmit elements may be spaced at approximately ½λ, and the receive elements may be spaced apart by 8×(½λ) thereby allowing a reduction of receive elements by a factor of 8 over conventional systems that require receive elements to be spaced apart at a distance of half a wavelength. For a reduction or thinning factor of 9, nine transmit elements may be spaced at approximately ½λ, and the receive elements may be spaced apart by 9×(½λ) thereby allowing a reduction of receive elements by a factor of 9 over conventional systems that require receive elements to be spaced apart at a distance of half a wavelength. For a reduction or thinning factor of 10, ten transmit elements may be spaced at approximately ½λ, and the receive elements may be spaced apart by 10×(½λ), thereby allowing a reduction of receive elements by a factor of 10 over conventional systems that require receive elements to be spaced apart at a distance of half a wavelength.

In some aspects, the reduction or thinning factor can be determined based on a desired number of transmit elements. The higher the number of transmit elements, the higher the reduction or thinning of receive elements. For example, if a system utilizes two transmit elements, the number of receive elements can be reduced by a factor of two. In another example, if a system utilizes three transmit elements, the number of receive elements may be reduced by a factor of three. In yet another example, if a system utilizes four transmit elements, the number of receive elements may be reduced by a factor of four. In yet another example, if a system utilizes five transmit elements, the number of receive elements can be reduced by a factor of five. In yet another example, if a system utilizes six transmit elements, the number of receive elements may be reduced by a factor of six. In yet another example, if a system utilizes seven transmit elements, the number of receive elements may be reduced by a factor of seven.

In another aspect, by reducing the number of transmit and receive elements necessary to generate high resolution images, processing power is significantly reduced thereby enabling processors to be integrated with the transmit and receive elements. By reducing the number of elements, data may also be processed at or near real-time thereby increasing the accuracy of images generated by the active array system.

FIG. 1 illustrates perspective view of an implementation of a thinned-array that can be implemented in an active array system, such as an active imaging radar system, according to some aspects of the technology. As illustrated in FIG. 1, "Na" defines a number of elements in Group (a) corresponding to transmit or radiating elements, and "Nb" defines a number of elements in Group (b) corresponding to receive elements. In the illustrated diagram of FIG. 1, "L" defines an overall aperture dimension (e.g., aperture width).

As discussed above, conventional arrays require the number of transmit elements and the number of receive elements to be equal, e.g., in a one-to-one ratio. The spacing in a conventional array is typically ½λ between the elements. Assuming the number of transmit elements in a conventional array is represented by "Nac" and the number of receive elements in a conventional array is represented by "Nbc," the number of conventional transmit elements is defined as Nac=2L/λ, and the number of conventional receive elements is defined as Nbc=2L/λ. The overall element count "Nc" in a conventional array is a function of aperture width "L" and wavelength (λ): Nc=Nac+Nbc=2L/λ (transmit elements)+2L/λ (receive elements); Nc=4L/λ.

In contrast to conventional arrays, the active array system of the disclosed technology achieves a reduction in the number of transmit elements Na and receive elements Nb and associated processing circuitry such that the total element count for the array system is Na+Nb, which is deterministically minimized to a fraction of that which is utilized in conventional arrays. The overall reduction fraction may be represented by the reduction or thinning factor "M" and is defined as: M=(Nac+Nbc)/(Na+Nb). Furthermore, a thinning factor of the transmit elements may be defined as "Mtx"=Nac/Na. Similarly, a thinning factor of the receive elements may be defined as "Mrx"=Nbc/Nb.

Referring to FIG. 1, in some implementations, the active array system may be configured to operate at millimeter wavelengths (e.g., 1 cm to 1 mm; 30 GHz to 300 GHz). For a desired reduction factor of 4, the array system may comprise a first array of transmit elements Na that includes four transmit elements spaced about half or near half a wavelength apart (e.g., 5 mm). The array system also comprises a second array of receive elements Nb that are spaced apart a distance that is greater than half a wavelength. Because of the thinning factor of 4, four transmit elements are utilized, therefore resulting in a spacing between the receive elements of 4×½λ, (e.g., 20 mm). The number of receive elements is one-quarter (e.g., 16 receive elements spaced 20 mm apart) of what would otherwise be utilized in a conventional phased array system (e.g., 64 receive elements spaced 5 mm apart), and the number of transmit elements (e.g., 4 transmit elements) is thus one-quarter of the number of receive elements (e.g., 16 receive elements); thus thinning is achieved.

In some aspects, the second array of receive elements Nb may be disposed across a plurality of receiver cards that together, provide the desired number of receive elements. By disposing the receive elements across the plurality of receiver cards, the array system may be scaled as desired, to accommodate varying applications and requirements. For example, referring back to FIG. 1, the second array Nb comprises four receiver cards with four receive elements disposed on each receiver card, providing a total of 16 receive elements. In some aspects, each receiver card can be configured to be sufficiently similar to other receiver cards, for example, to facilitate scaling of the array system with ease and without requiring significant modification of the hardware. In one aspect, because the receive elements are disposed amongst the plurality of receiver cards, spacing between receive elements disposed on adjacent receiver cards is maintained and does not change. For example, should an implementation require additional receive elements to obtain higher precision (e.g., increase the number of receive elements from 16 to 24), two additional receiver cards having four receive elements each may be added to the array system by simply extending a width of a backplane to accommodate the two additional receiver cards.

The array system can utilize electronic beam steering to sweep the transmit elements across a target area. In one aspect, because the array system does not require mechanical components to perform the sweep, the array system may provide more than 15 frames per second. In other aspects, the array system may provide up to 30 frames per second. In other aspects, the array system may provide up to 60 frames per second. In other aspects, the array system may provide up to 100 frames per second.

The array system may also provide angular resolution which is not limited by the accuracy of mechanical components (e.g., gearing reduction or mechanical linkages). Conventional mechanical systems may provide angular precision of up to 2 degrees and conventional array systems may provide angular precision of up to 1 degree. In contrast, the array system of the disclosed technology may be configured to provide precise steering angles limited only by the arithmetic precision of the processing system which may be about 10× more precise over conventional array systems.

Figure 2:
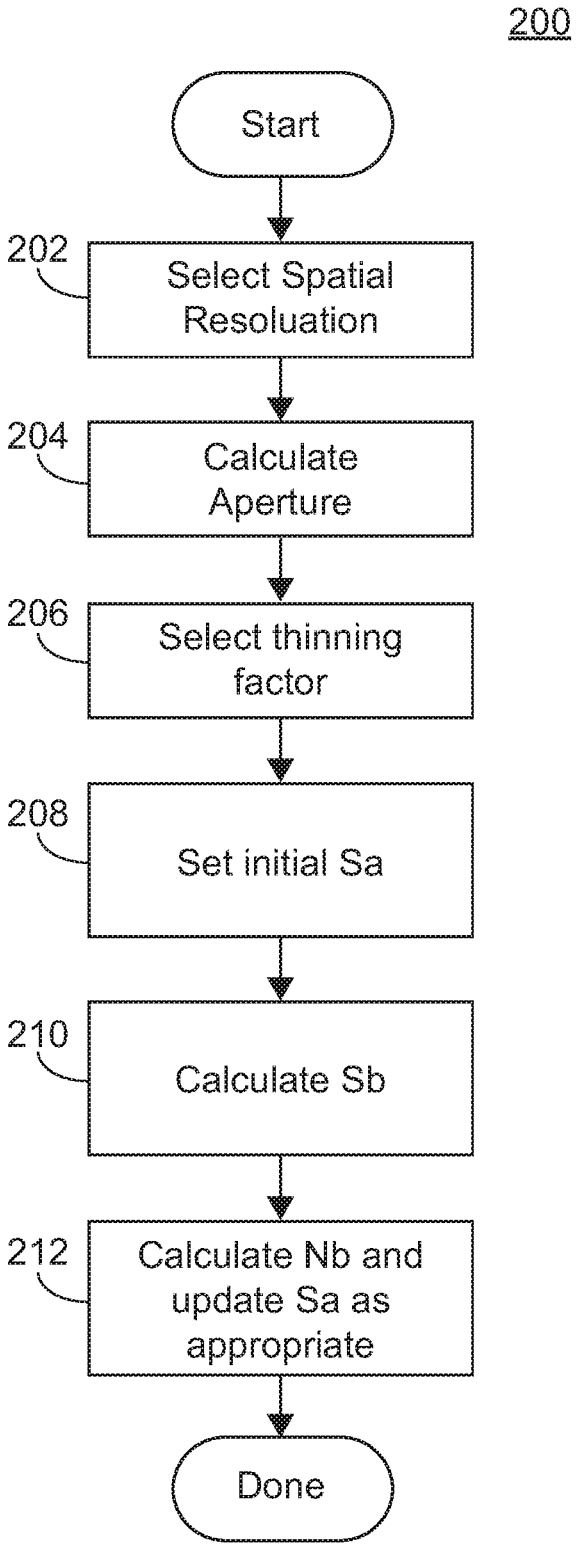
FIG. 2 illustrates steps of an example process for designing a thinned-array, according to some aspects of the disclosed technology.

FIG. 2 illustrates steps of an example process 200 for designing a thinned-array system of the disclosed technology. Process 200 begins with step 202 in which a spatial resolution is selected. The spatial resolution may be selected based on a desired application for the thinned-array system (e.g., object detection, weather, etc.). The spatial resolution may be defined as the half power beam width, $\theta_{HPBW}$. By way of example, a spatial resolution of 1.6 degrees may be selected. Converting the spatial resolution to radians, the desired $\theta_{HPBW}$ is approximately 0.0279.

Next, in step 204, an aperture width (L) is calculated. The aperture, L, is defined as:

$$L=0.89*\lambda/(\theta_{HPBW}) \quad \text{Equation 1}$$

Substituting the normalized aperture L'=L/λ into Equation 1, yields:

$$L'=0.89/(\theta_{HPBW}), \text{ thus } L'\approx 31.871 \quad \text{Equation 2}$$

The normalized aperture L' is unitless. To re-introduce it in later stages, it is multiplied by λ. The use of L' is proof that the disclosed technology is frequency agnostic and is applicable over all frequency bands.

Next, at step 206, a thinning factor ($M_{rx}$) is selected. By way of example, a thinning factor Mrx of 4 may be selected. A number of elements in Group (a), Na, may be defined as Na=$M_{rx}$. Here, because the thinning factor is 4, the number of elements in Group (a) is 4.

"Sa" may define a spacing of the elements in Group (a) and is normalized to wavelength. Subsequently, in step 208, Sa is initially set to ½λ as a baseline and may be refined in step 212 of process 200.

"Sb" may define a spacing of the elements in Group (b) and is normalized to wavelength. In step 210, in order to achieve the apparatus orthogonality between Group (a) and Group (b), the spacing in Group (b), Sb, is defined as:

$$Sb=Na*Sa, \text{ thus } Sb=4*\tfrac{1}{2}\lambda=2\lambda \quad \text{Equation 3}$$

In step 212, a number of elements in Group (b), Nb, is calculated. Nb must be an integer and is defined as:

$$Nb=L'\lambda/Sb+1, \text{ thus } Nb=31.87\lambda/2\lambda+1=16.935 \quad \text{Equation 4}$$

Because, the result for Nb=16.935 is not an integer, Nb may be rounded up to 17 resulting in the number of elements in Group (b) to be 17. It may, however, be desirable to round Nb down to 16 because 17 is a prime number and has no factors, whereas 16 is a power of 2 and has many factors. In one aspect, to enable the array system of the disclosed technology to be modular, as discussed above, and arrange the elements in Group (b) across a plurality of PCB cards that together, provide the total number of elements Nb, 16 may be more desirable than 17. In this example, for a number of elements in Group (b) of 16, the number of Group (b) elements may be divided across four PCB cards, with each PCB card having four Group (b) elements disposed thereon.

Continuing with step 212, the spacing of the elements in Group (a) may be adjusted. If Nb is 16, then by using the relationship of Equation 4, Sb may be determined by:

$$Sb=L'\lambda/(Nb-1),\ \text{thus}\ Sb=31.871\lambda/15\approx 2.125\lambda. \qquad \text{Equation 5}$$

Using the relationship in Equation 3, the updated Sa may be calculated as:

$$Sa=Sb/Na,\ \text{thus}\ Sa2.125\lambda/4=0.5312\lambda. \qquad \text{Equation 6}$$

For the purposes of this example, Sa is within 10% of ½λ and is acceptable.

For some implementations, if a precise ½λ is desired for Sa, then process 200 may be applied in reverse and the spatial resolution may be calculated. For example, continuing with the example for process 200, it has been established that Nb=16, Sb=2λ, Na=4, Sa=½λ. Thus using Equation 4 and solving for L' yields:

$$L'\lambda=(Nb-1)*Sb,\ \text{thus}\ L'=15*2=30 \qquad \text{Equation 7}$$

Using Equation 2, the spatial resolution $\theta_{HPBW}$=0.89λ/(L'λ) =0.0297 radians, or 1.7 degrees.

In some aspects, choosing whether to design the array system of the disclosed technology using process 200 in a forward direction (from step 202-212) or reverse direction (from step 212-202), is based on design considerations for a particular application for the array system. In other aspects, regardless of which direction process 200 is applied (forward or reverse), the array system of the disclosed technology achieves an orthogonality between Group (a) and Group (b), and a reduction in the number of elements in the array. In this example, the total number of elements in the array system of the disclosed technology is Na+Nb=4+16=20 elements.

Compared to a conventional steerable array with a 31.87λ aperture, the number of elements in Group (a), Nac, would be 64 transmit elements, and the number of elements in Group (b), Nbc, would be 64 receive elements at ½λ spacing, thus the total number of elements, Nc, would be 128.

Referring back to the example described above, the array system of the disclosed technology, designed using process 200, contains 4 elements in Group (a), Na=4, and 16 elements in Group (b), Nb=16. Thus, the thinning factor of the transmit elements, Mtx, is 16, as defined by Mtx=Nac/Na=64/4=16; and the thinning factor of the receive elements, Mrx, is 4, as defined by Mrx=Nbc/Nb=64/16=4; and the overall thinning factor, M, is 6.4, as defined by M=(Nac+Nbc)/(Na+Nb)=128/20=6.4.

In one aspect, because the array system of the disclosed technology is designed independent of frequency, the array system may be used in a wide variety of applications. For example, if the application for the array system is radar and the desired frequency is in the Ka band of the electromagnetic spectrum with an operating frequency of 30 GHz, the wavelength λ would be approximately 10 mm. Using process 200, the array parameters may be calculated as follows: Using Equation 7, the aperture width L'λ=30λ=30*10 mm=300 mm. The spacing of the elements in Group (a) Sa=½λ=½*10 mm=5 mm. Using Equation 6 and solving for Sb, the spacing of the elements in Group (b) Sb=Na*Sa=4*5 mm=20 mm.

In another example, if the application for the array system of the disclosed technology is optical in nature, such as for a phased array LIDAR, and the operating frequency is desired in the Near IR band of 10 micron, then λ would be 10 μmeters. Using process 200, the resultant array parameters may be calculated as follows: Using Equation 7, the aperture width L'λ=30λ=30*10 μm=300 μm. The spacing of the elements in Group (a) Sa=½λ, =½*10 μm=5 μm. Using Equation 6 and solving for Sb, the spacing of the elements in Group (b) Sb=Na*Sa=4*5. μm=20 μm.

In another example, if the application for the array system of the disclosed technology is SONAR, and the operating frequency is desired in the ultrasonic band of 150 kHz in water with a propagation speed of 1481 m/s, then λ would be 9.8733 mm. Using process 200, the resultant array parameters may be calculated as follows: Using Equation 7, the aperture width L'λ=30λ=30*9.8733 mm=296.2 mm. The spacing of the elements in Group (a) Sa=½λ, =½*9.8733 mm=4.94 mm. Using Equation 6 and solving for Sb, the spacing of the elements in Group (b) Sb=Na*Sa=4*4.94 mm=19.76 mm.

Figure 3:
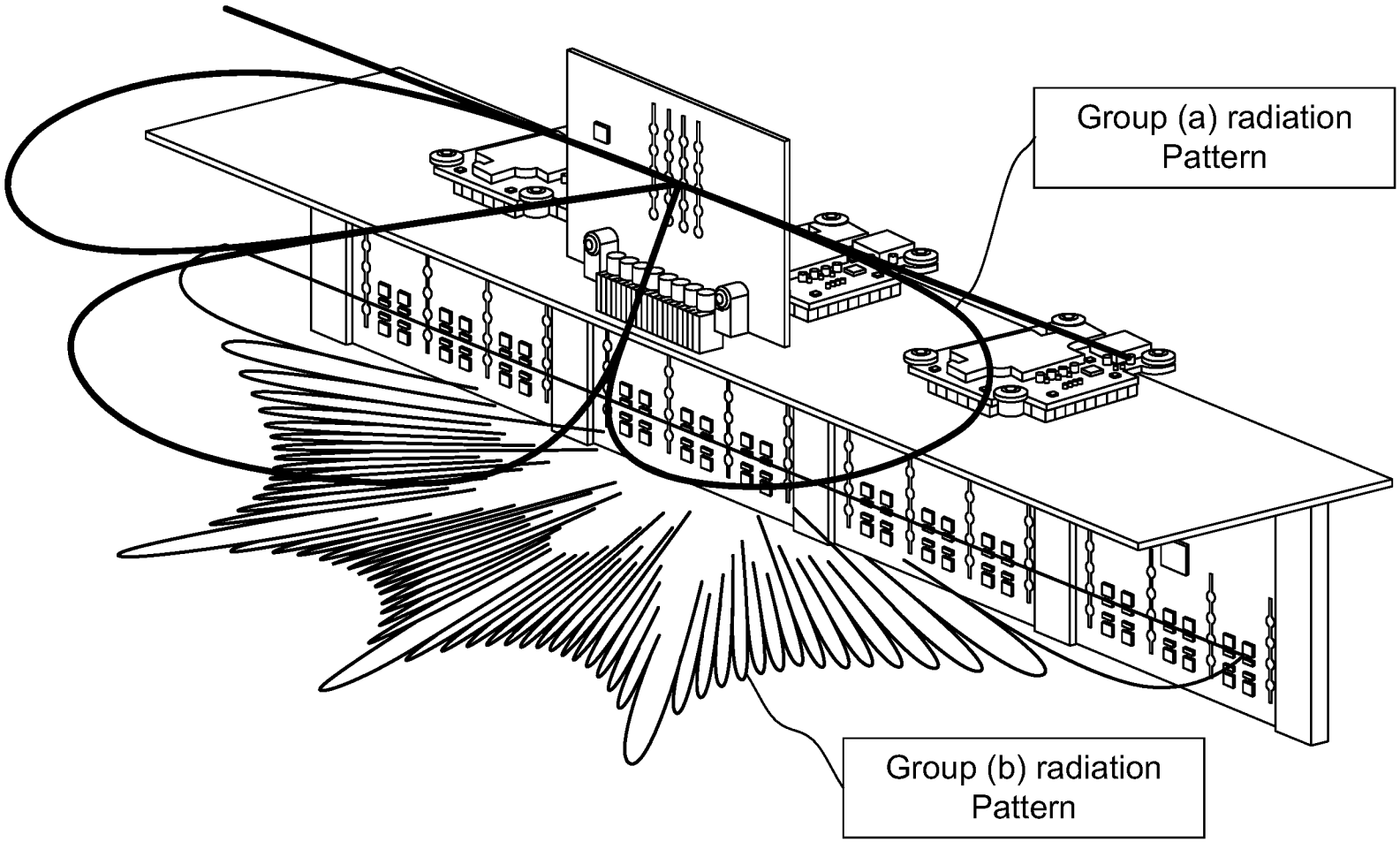
FIG. 3 graphically illustrates an example of a transmit—Group (a)—radiation pattern, and a receive—Group (b)—radiation pattern or vice versa, according to some aspects of the disclosed technology.
Figure 4:
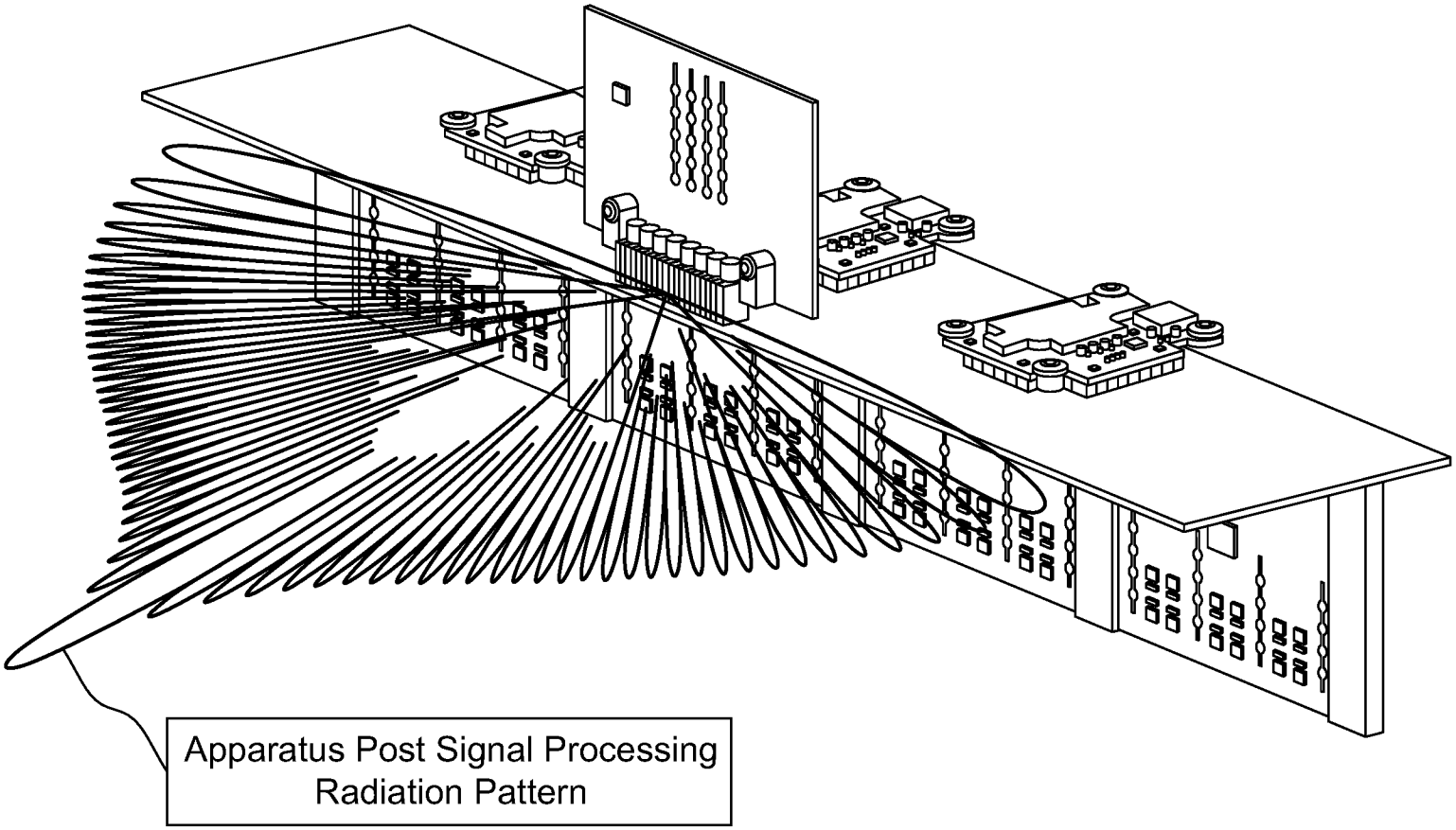
FIG. 4 illustrates an example of a radiation pattern after the application of signal processing, according to some aspects of the disclosed technology.

Software:

FIG. 3 graphically illustrates an example of a transmit—Group (a)—radiation pattern, and a receive—Group (b)—radiation pattern, according to some aspects of the disclosed technology. FIG. 4 illustrates an example of a received radiation pattern after the application of signal processing, according to some aspects of the disclosed technology. Given the relationships described in FIG. 2, the thinned array exhibits two sets of radiation patterns, one for Group (a), and one for Group (b), as illustrated in FIG. 3. In some aspects, the software running on the signal processor(s) illustrated in FIG. 1 is configured to process the radiation patterns depicted in FIG. 3 to select a primary lobe of the overall system radiation pattern (as shown in FIG. 4) for signal and/or video processing. In other aspects, the array system is configured to select and steer the primary lobe as is depicted in FIG. 4.

In the configuration shown in FIGS. 3 and 4, the disclosed array system exhibits a highly directional beam and, with the aid of software, may be steered across the aperture. This beam steering can be used in some aspects as an imaging system whereby an image is generated based on the single lobe or beam where the maxima of the transmit and receive elements coincide. In some aspects, the array system may have a viewing angle of −90° to +90°. By modifying Sa the overall system may be thinned even further to achieve higher spatial resolution at the expense of other parameters, such as viewing angle.

In another aspect, the array system may be configured to utilize more than one beam, or a multi-beam. For example, the array system may be configured to utilize two beams having a viewing angle of −45° to +45° each. In another example, the array system may be configured to utilize three beams each with a viewing angle of −30° to 30°. In yet another example, the array system may be configured to utilize four beams each with a viewing angle of −22.5° to 22.5°. In yet another example, the array system may be configured to utilize five beams each with a viewing angle of −18° to 18°. In yet another example, the array system may be configured to utilize six beams each with a viewing angle of −15° to 15°. In yet another example, the number of beams formed by the array system is dependent on the signal processing and is only limited by available processing power. Thus, 7, 8, 9, 10, 11, 12, 13 and so on beams may be readily realized. It is understood that additional beams are contemplated without departing from the scope of the invention. By increasing the number of beams, the sweep rate of the array system may also be increased.

Figure 5:
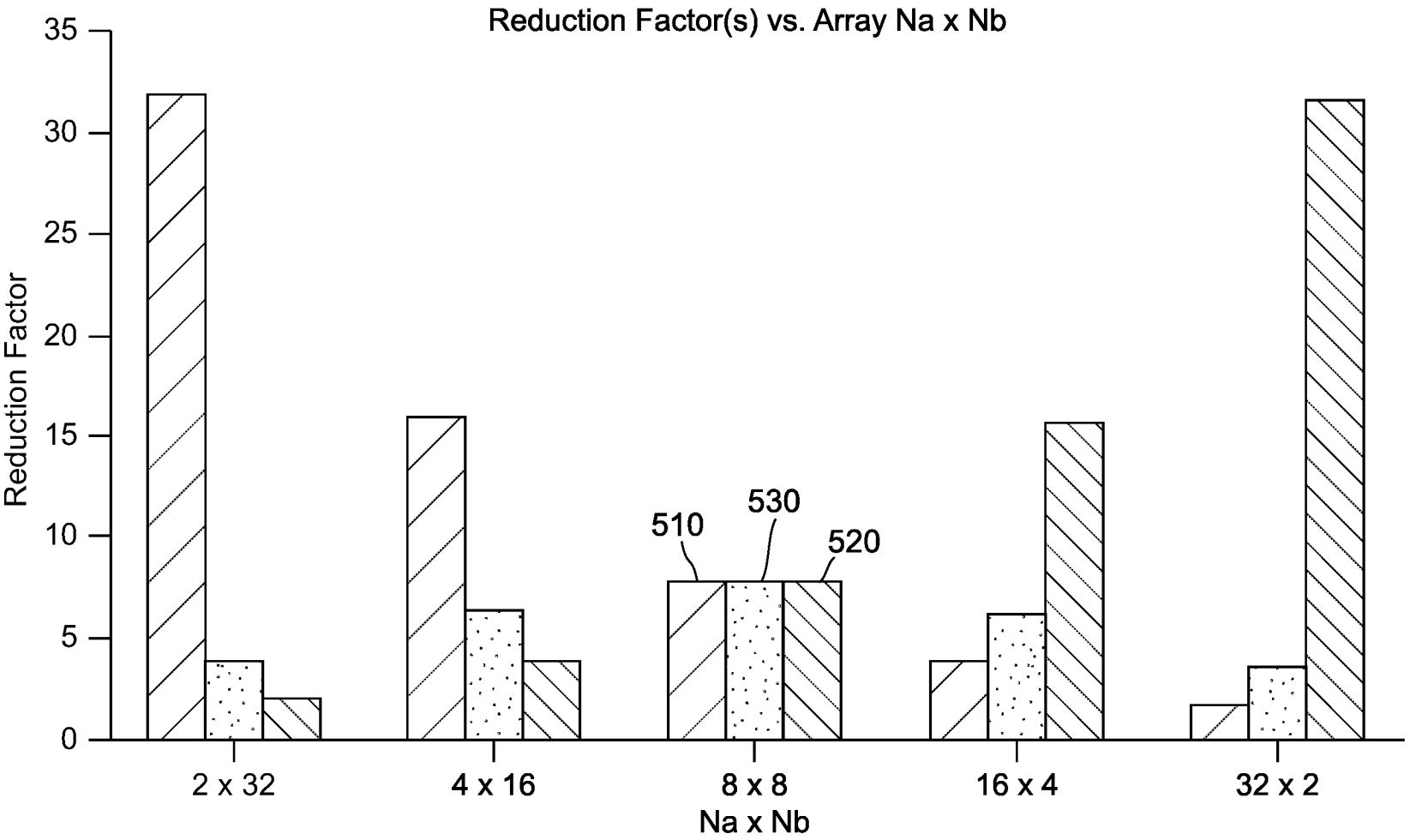
FIG. 5 graphically illustrates an example of a thinning or reduction factor as a function of element group size, according to some aspects of the technology.

FIG. 5 graphically illustrates an example of the total reduction or thinning factors (M, Mtx and Mrx) as a function of the number of transmit elements (Na) and number of receive elements (Nb), according to some aspects of the technology. As shown in FIG. 5, for all possible configurations of Na and Nb, the overall reduction factor is significantly in excess of 1, i.e. the array system achieves a reduction in the number of elements for all possible configurations. With reference to FIG. 5, 510 indicates a reduction of elements in Group (a), Mtx, as a function of Na and Nb. 520 indicates a reduction factor of elements in Group (b), Mrx, as a function of Na and Nb. 530 indicates an overall reduction factor for the total number of elements, M, as a function of Na and Nb. It is evident from FIG. 5 that an overall reduction of 8 may be attained for an Na and Nb arrangement comprising 8×8. It may, however, be advantageous to have an Na and Nb arrangement comprising 4×16 for modularity as described above. In a 4×16 configuration, a reduction factor in excess of 6 may be attained. In one aspect, it may be desirable to maximize Mtx, which as shown in FIG. 5, may be attained with an Na and Nb arrangement comprising 2×32. In this arrangement, the overall reduction factor is 3.76. In other aspects, it may be desirable to maximize Mrx, which as shown in FIG. 5, may be attained with an Na and Nb arrangement comprising 32×2. In this arrangement, the overall reduction factor is 3.76. In one aspect, the array system may achieve values of 7× in reduction of elements as a size of the array increases.

Derivation:

It is understood that all contemplations in the following sections are contemplated without departing from the scope of the invention and serve solely to clarify the derivation of the array system's governing equations. It is also understood that all the equations presented are in vector form and thus fully describe and quantify all possible array systems and all simplifications are contemplated for clarity and without departing from the scope of the invention. It is also understood that the treatment of the disclosed technology as a uniformly spaced array is also contemplated for clarity without departing from the scope of the invention.

Independent of wavelength, when combining sources or receivers in a coherent process, the resultant far field transmission or reception pattern can be expressed by an Array Factor (AF) defined as follows:

$$AF(\hat{r})=\Sigma_{n=0}^{N-1}\omega_n e^{-jk\cdot r_n} \qquad \text{Equation 8:}$$

To those familiar with the art, $\omega_n$ are the complex valued coefficients which may be used to steer the array of N elements. Furthermore, k is the wave number vector and $r_n$ is the direction vector, in some aspects, of the inbound wave-front, and in other aspects, of the outbound wave front. In some aspects steering may be performed using analog phase shifters. In other aspects, steering may be performed using digital signal processing.

The wave number vector k is used to describe the space wave established by the coherent process. To those familiar with the art, k is defined as the vector: k=[kx,ky,kz], where $k_x$, $k_y$ and $k_z$ denote the component of the wave vector along the x, y and z axes. This can be re-factored as, k=2*pi/λ*P, where P is a unit projection vector. Therefore, the magnitude of k is defined as $(2*pi/\lambda)^2*|P|^2=|k|^2$. Because P is a unit projection vector, $|P|^2=1$ thus $|k|^2=(2*pi/\lambda)^2\rightarrow|k|=2*pi/\lambda$.

When referring to the wave number, as opposed to the wave number vector, i.e. k vs. k, the magnitude of k, the wave number assumes the value of the magnitude of the wave number vector, i.e. k=|k|=2*pi/λ without departing from the scope of the invention.

Whereas only three dimensions are contemplated, hyper-dimensional k and r vectors, i.e. more than 3 dimensional, may exist and may be contemplated for some aspects. For the purposes of the disclosed technology, three dimensions suffice for proof of utility, and are contemplated without departing from the scope of the invention.

Figure 6:
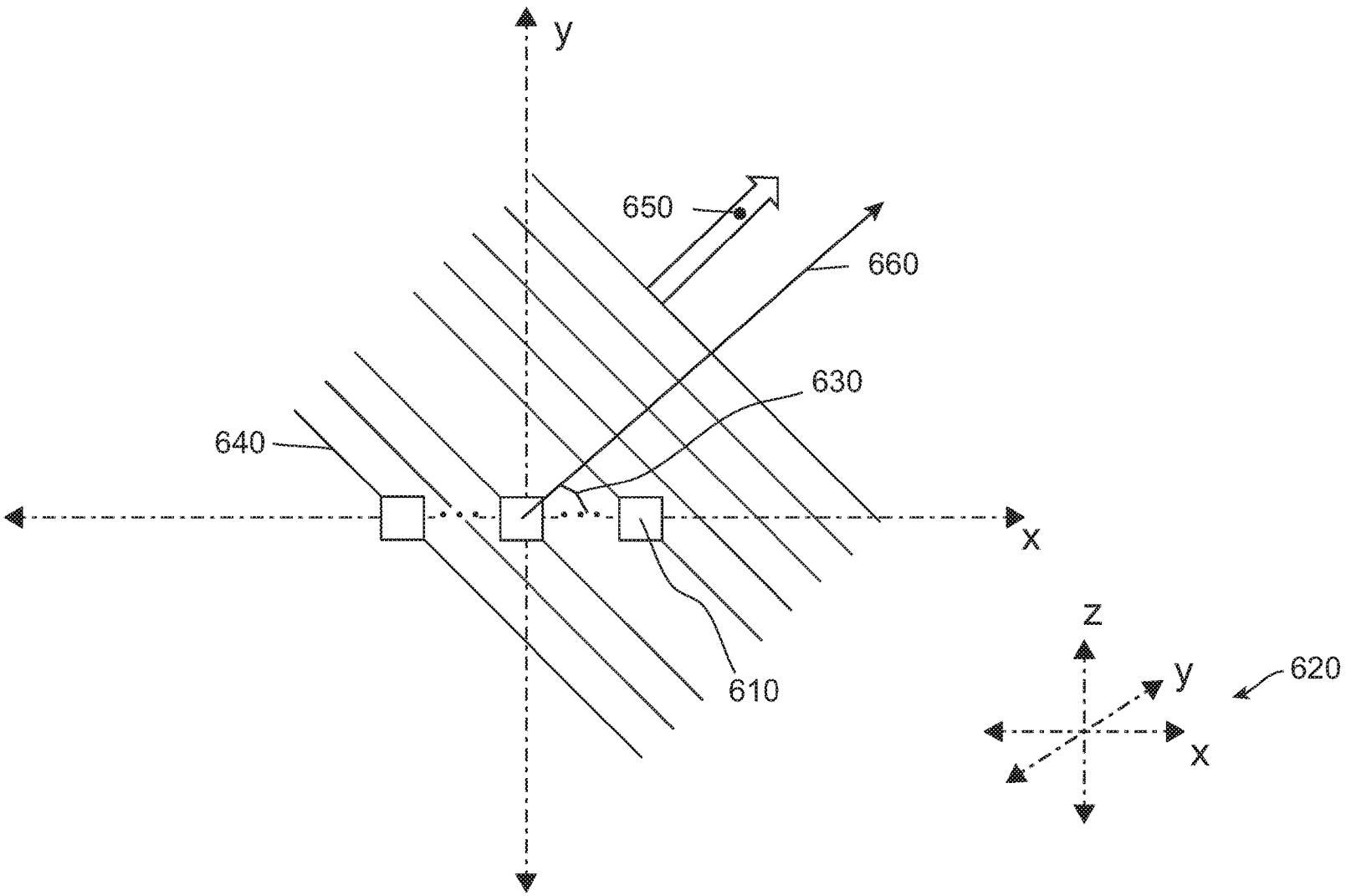
FIG. 6 illustrates an example coordinate system with relevant array coordinate parameters used in a derivation section, according to some aspects of the disclosed technology.

FIG. 6 illustrates an example coordinate system with relevant array coordinate parameters used in a derivation section, according to some aspects of the disclosed technology. With reference to FIG. 6, a linear array is contemplated for clarity and without departure from the scope of this invention. For a linear array of N elements (610), a coordinate frame (620) is selected such that the angle of incidence, θ (630), of the electromagnetic wave-front vector (650) is denoted as 0 degrees, or 0 radians, when the vector (650) is parallel to the axis of the array (620); and is denoted as 90 degrees, or π/2 radians, when the vector (650) is perpendicular to the axis of the array (620); and θ (630) is denoted as 180 degrees, or π radians, when the vector (650) is parallel to the axis of the array and is originating from, i.e. with the source, opposite the side of 0 degrees. The wave-front is depicted in 640 and is inherently perpendicular to the wave front vector (650). In this coordinate system, $\omega_n$ is contemplated, for clarification of the vector equation, as the complex exponential:

$$\omega_n=e^{jknd\cdot\cos(\theta_d)} \qquad \text{Equation 9:}$$

Where $\theta_d$ is defined as the angle subtended between the steering vector (660) and the axis of the array (620). In this coordinate frame, the steering vector dot product, $k\cdot r_n$, can be represented by:

$$k\cdot r_n=knd\cdot\cos(\theta) \qquad \text{Equation 10:}$$

Where θ is the angle of the wave-front (640) resulting in the steering vector (660) in the same coordinate frame of the array contemplated above. Substituting Equation 9 and Equation 10 into Equation 8 yields:

$$AF(\theta_d,\theta)=\Sigma_{n=0}^{N-1}e^{jknd(\cos(\theta_d)-\cos(\theta))} \qquad \text{Equation 11:}$$

This summation is in the standard form whose closed form solution is given:

$$\sum_{n=0}^{N-1} Q^n = \frac{1-Q^N}{1-Q} \qquad \text{Equation 12}$$

Substituting the dummy variable Q for the complex exponential in Equation 12 yields a closed form solution for the AF expressed as:

Equation 13

$$AF = \frac{1-e^{jkNd(\cos(\theta_d)-\cos(\theta))}}{1-e^{jkd(\cos(\theta_d)-\cos(\theta))}}$$

Calculating the magnitude of the AF in Equation 13 and using the Euler identity for the complex representation of sine as shown below in Equation 14, simplifies the AF to the form shown in Equation 15:

Equation 14

$$\sin(\theta) = \frac{e^{j\theta} - e^{-j\theta}}{2j}$$

Equation 15

$$|AF| = \left| \frac{\sin\left(\frac{kNd[\cos(\theta_d) - \cos(\theta)]}{2}\right)}{\sin\left(\frac{kd[\cos(\theta_d) - \cos(\theta)]}{2}\right)} \right|$$

Equation 15 indicates that there are locations of minima and maxima within the array factor. These locations are periodic in nature as the sine function is periodic in nature. The maxima and minima occur when the denominator and numerator of Equation 15 are minimized, respectively. Equation 15 has maxima when the denominator approaches or is equal to 0. This occurs when the argument of the sine is an integer multiple of π, and is described as:

Equation 16

$$\sin\left(\frac{kd[\cos(\theta_d) - \cos(\theta)]}{2}\right) = 0 \text{ when } \frac{kd[\cos(\theta_d) - \cos(\theta)]}{2} = \pm m\pi, \text{ where } m = 0, 1, 2, \ldots$$

Rearranging the argument of the sine, expanding the wave number, k, and solving for the [cosine] terms, the relationship described by Equation 16 is met when:

Equation 17

$$[\cos(\theta_d) - \cos(\theta)] = \frac{\pm m\lambda}{d}, \text{ where } m = 0, 1, 2, \ldots$$

Similarly, Equation 15 has a minimum when the numerator is equal to zero while the denominator is non-zero. This is described as:

Equation 18

$$\sin\left(\frac{kNd[\cos(\theta_d) - \cos(\theta)]}{2}\right) = 0 \text{ when } \frac{kNd[\cos(\theta_d) - \cos(\theta)]}{2} = \pm n\pi, \text{ where } n = 0, 1, 2, \ldots$$

Rearranging the argument of the sine, expanding the wave number, k, and solving for the [cosine] terms, the relationship described by Equation 17 is met when:

Equation 19

$$[\cos(\theta_d) - \cos(\theta)] = \frac{\pm n\lambda}{Nd}, \text{ where } n = 0, 1, 2, \ldots$$

Equations 17 and 19 show that the maxima and minima are proportional to the spacing d. Specifically, as "d" increases, the number of maxima and minima increase proportionally.

Figure 7:
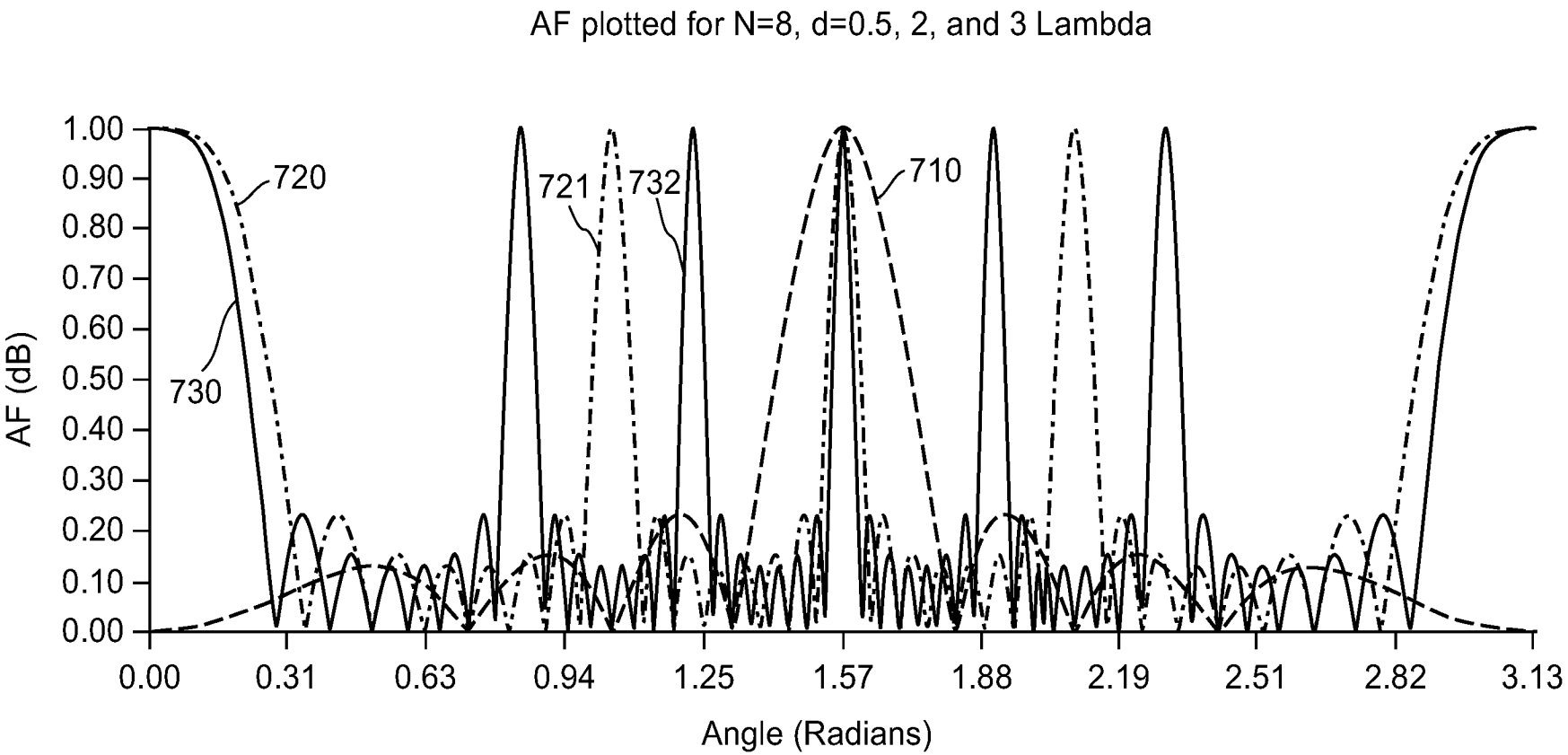
FIG. 7 illustrates a relationship of an Array Factor (AF) and spacing of an element at 0.5λ, 2λ, and 3λ.

FIG. 7 illustrates a relationship of an Array Factor (AF) and spacing of an element at 0.5λ, 2λ, and 3λ. With reference to FIG. 7, the number of peaks is clearly shown to increase with d: 710 indicates the array factor with d=½λ; 720 represents the array factor with d=2λ; 730 represents the array factor for d=3λ.

As described above, because the array system has two groups of elements, Group (a) and Group (b), the number of elements in Group (a) is represented by "Na" and the number of elements in Group (b) is represented by "Nb." The spacing "d" between the elements of Group (a) is represented by "$S_a$" and the spacing between the elements of Group (b) is represented by "$S_b$".

The resultant maxima of Group (a) and Group (b) can be derived from Equation 17 as:

Equation 20

$$[\cos(\theta_d) - \cos(\theta)] = \frac{\pm m\lambda}{S_a}, \text{ where } m = 0, 1, 2, \ldots \quad \text{(a)}$$

Equation 21

$$[\cos(\theta_d) - \cos(\theta)] = \frac{\pm m\lambda}{S_b}, \text{ where } m = 0, 1, 2, \ldots \quad \text{(b)}$$

The resultant minima of Group (a) and Group (b) can be derived from Equation 19 as:

Equation 22

$$[\cos(\theta_d) - \cos(\theta)] = \frac{\pm n\lambda}{N_a S_a}, \text{ where } n = 0, 1, 2, \ldots \quad \text{(a)}$$

Equation 23

$$[\cos(\theta_d) - \cos(\theta)] = \frac{\pm n\lambda}{N_b S_b}, \text{ where } n = 0, 1, 2, \ldots \quad \text{(b)}$$

The resultant AF of Group (a) can be expressed by substituting $N_a$ and $S_a$ into Equation 15 yielding:

Equation 24

$$|AF_a| = \left| \frac{\sin\left(\frac{kN_aS_a[\cos(\theta_d) - \cos(\theta)]}{2}\right)}{\sin\left(\frac{kS_a[\cos(\theta_d) - \cos(\theta)]}{2}\right)} \right|$$

The resultant AF of Group (b) can be expressed by substituting $N_b$ and $S_b$ into Equation 15 yielding:

Equation 25

$$|AF_b| = \left| \frac{\sin\left(\frac{kN_bS_b[\cos(\theta_d) - \cos(\theta)]}{2}\right)}{\sin\left(\frac{kS_b[\cos(\theta_d) - \cos(\theta)]}{2}\right)} \right|$$

To achieve the reduction factor, the array system is constructed with the spacing in Group (a) and/or Group (b) with $S_a$ and/or $S_b$ greater than ½λ.

It has been established that spacing in excess of ½λ, will result in conventionally undesirable grating lobes. With reference to FIG. 7, recall that 710 represents ½λ, spacing; 720 represents 2λ spacing; and 730 represents 3λ, spacing. These undesired grating lobes can be seen at the callout 721, and at the callout 732. Curve 720 has 5 peaks with AF=1 located at approximately 0, 1.05, 1.57, 2.09 and 3.14 radians. Furthermore, these undesired grating lobes can also be seen on curve 730. This curve has 7 peaks with AF=1 located at approximately 0, 0.840, 1.23, 1.57, 1.91, 2.30, 3.13 radians. In contrast, 710 does not show any grating lobes and only contains one main lobe at approximately 1.57 radians. It is also evident from FIG. 7 that all element spacings synthesize a lobe at approximately 1.57 radians. This lobe is mathematically defined in Equation 17 when m=0. It is also evident from FIG. 7 that all element spacing in excess of ½λ, synthesize multiple grating lobes. These lobes are mathematically defined in Equation 17 when m≠0.

It is also evident from FIG. 7 that all element spacing contains minima, i.e. where AF=0. In some aspects, with ½λ, spacing as illustrated by 710, these minima are located at approximately 0, 0.72, 1.05, 1.32, 1.82, 2.09, 2.42 and 3.14 radians. With a 2λ spacing as illustrated by 720, these minima are located at approximately 0.36, 0.51, 0.62, 0.72, 0.81, 0.9, 0.97, 1.12, 1.19, 1.25, 1.32, 1.38, 1.45, 1.51, 1.63, 1.7, 1.76, 1.82, 1.89, 1.96, 2.02, 2.17, 2.25, 2.33, 2.42, 2.52, 2.64 and 2.79 radians. With a 3λ, spacing as illustrated by 730, these minima are located at approximately 0.29, 0.41, 0.51, 0.59, 0.66, 0.72, 0.78, 0.9, 0.95, 1, 1.05, 1.09, 1.14, 1.19, 1.27, 1.32, 1.36, 1.4, 1.45, 1.49, 1.53, 1.61, 1.65, 1.7, 1.74, 1.78, 1.82, 1.87, 1.96, 2, 2.05, 2.09, 2.14, 2.19, 2.25, 2.36, 2.42, 2.48, 2.56, 2.64, 2.73 and 2.85 radians.

In one aspect of the subject technology, by constructing the array system with a specific relationship between $S_b$, $N_a$ and $S_a$, it is now possible to (1) synthesize the main lobe of Group (b) to be coincident or in the vicinity of the main lobe of Group (a), and (2) synthesize the undesired maxima (e.g., grating lobes) of Group (b) to be coincident or in the vicinity of the minima of Group (a).

As described above with reference to Equation 3, Sb=Na*Sa. By substituting Equation 3 into the maxima equation for Group (b) defined in Equation 21, the location of the maxima of Group (b) may be identified:

Equation 26

$$[\cos(\theta_d) - \cos(\theta)] = \frac{\pm m\lambda}{N_a S_a}, \text{ where } m = 0, 1, 2, \ldots$$

Applying the cosine term of this calculation to the Array Factor for Group (a), defined in Equation 24, and expanding the wave number, k, we get the following relationship:

Equation 27

$$|AF_a| = \left| \frac{\sin\left(\frac{2\pi}{\lambda} N_a S_a \frac{\pm m\lambda}{N_a S_a}\right)}{\sin\left(\frac{2\pi}{\lambda} S_a \frac{\pm m\lambda}{N_a S_a}\right)} \right| \text{ where } m = 0, 1, 2, \ldots$$

Cancelling like terms, the resulting form of the Group (a) Array Factor is:

Equation 28

$$|AF_a| = \left| \frac{\sin(\pm m\pi)}{\sin\left(\frac{\pm m\pi}{N_a}\right)} \right| \text{ where } m = 0, 1, 2, \ldots$$

Equation 28 shows that for all m where m≠0, i.e. non-primary lobe, and m≠ b*$N_a$, where b is 1, 2, 3 . . . the numerator evaluates to 0 while the denominator is non-zero—thus indicating a minimum. Equation 28 also shows that for m=0, and m=b*$N_a$, where b is 1, 2, 3 . . . the denominator evaluates to 0—thus indicating a maximum. Accordingly, it is shown that by constructing the array system with a specific relationship between $S_b$, $N_a$ and $S_a$, it is possible to (1) synthesize the main lobe of Group (b) to be coincident or in the vicinity of the main lobe of Group (a), and (2) synthesize the undesired maxima (e.g., grating lobes) of Group (b) to be coincident or in the vicinity of the minima of Group (a).

Furthermore, it is clear that the maxima occurring at m=b*$N_a$ are subject to the constraints of Equation 21. Examining Equation 21, the left-hand side is limited in range between −1 and 1, when adjusted for steering angle. This imposes a constraint on the valid range for the right-hand side represented by:

Equation 29

$$-1 \le \frac{m\lambda}{S_b} \le 1, \text{ where } m = \cdots, -2, -1, 0, 1, 2, \ldots \quad \text{(a)}$$

Therefore, m must always satisfy the condition:

Equation 30

$$-\frac{S_b}{\lambda} \le m \le \frac{S_b}{\lambda}, \quad \text{(b)}$$
$$\text{when } m = \ldots, -3, -2, -1, 0, 1, 2, \ldots$$

This constraint when applied to Equation 28 indicates that there will be a lobe at the main lobe where m=0, and there can only be as many grating lobes as permitted by Equation 30. For example, and in reference to FIG. 7, in 710, Sb=0.5λ→−0.5≤m≤0.5. The only valid value for m is 0 therefore there can only be a main lobe. In 720, Sb=2λ→−2≤m≤2, therefore m can assume the values −2, −1, 0, 1, and 2 thus there will be 5 lobes, 4 of which are undesired grating lobes (m≠0), and 1 of which is the main lobe (m=0) when Sb=2λ. Furthermore, in 730, Sb=3λ→−3≤m≤3; therefore, m can assume the values −3, −2, −1, 0, 1, 2, and 3 indicating there will be 7 lobes, 6 of which are grating (m≠0), and 1 of which is the main (m=0).

Equations 28, 29 and 30 establish the relationships which identify the empirical observations shown in FIG. 7 and described above.

Beam Width Calculations:

The half power beam-width of the array is determined when Equation 15 is equal to 1/√2 (i.e. −3 dB) and solving for $\theta_d$. Doubling this result yields the half power beam width angle of the array which is defined using Equation 2 as:

$$\theta_{HPBW} \cong 0.89 * \lambda / L \text{ or } \theta_{HPBW} = 0.89 / L' \quad \text{Equation 30}$$

Figure 8:
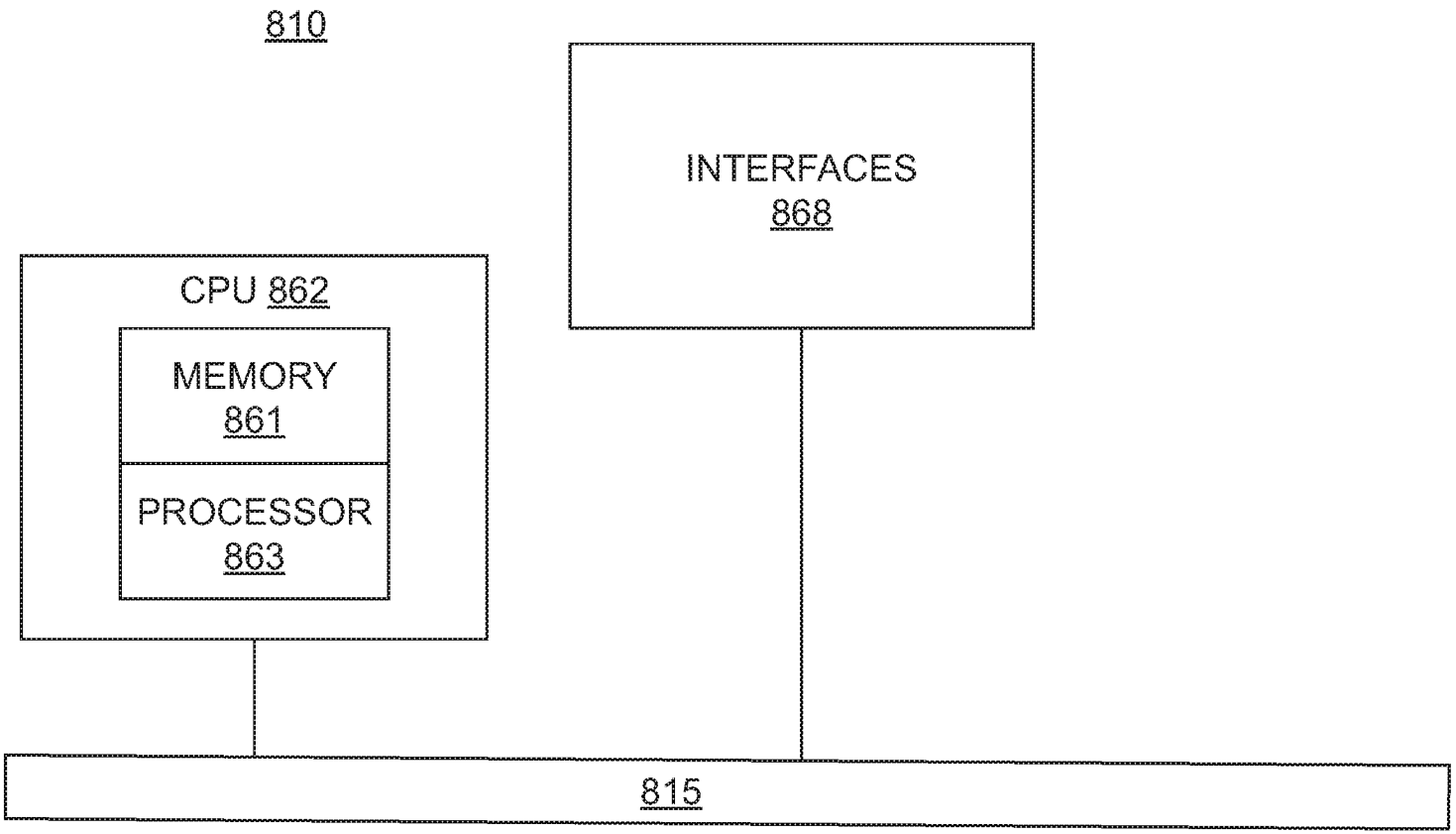
FIG. 8 illustrates an example processor-based device that can be used to implement an active imaging system and/or a signal processing system (an application), according to some aspects of the disclosed technology.

FIG. 8 illustrates an example processor-based device that can be used to implement an active array system and/or a signal processing system, according to some aspects of the disclosed technology. FIG. 8 illustrates an example processing-based device 810. Device 810 includes a master central processing unit (CPU) 862, interfaces 868, and bus 815 (e.g., a PCI bus). When acting under the control of appropriate software or firmware, CPU 862 can be configured for performing operations for managing transmission of one or more transmit elements and/or the receipt and processing of reflected signals resulting from said transmission. CPU 862 preferably accomplishes all these functions under the control of software including an operating system and any appropriate applications software and/or firmware. CPU 862 can include one or more processors, or processing cores, 863 such as a processor from the Motorola family of microprocessors, or the ARM family of microprocessors and may be coupled with Application Specific Integrated Circuits (ASICs), Field Programmable Gate Arrays (FPGAs) such as Xilinx, Altera, Microsemi, and Lattice semiconductor, and digital signal processors (DSPs) such as those provided by various vendors such as TI and Analog Devices. In a specific embodiment, a memory 861 (such as non-volatile RAM and/or ROM) also forms part of CPU 862. However, there are many different ways in which memory can be coupled to device 810.

Interfaces 868 can be interface cards (sometimes referred to as "line cards"). Among the interfaces, Ethernet interfaces, frame relay interfaces, cable interfaces, DSL interfaces, token ring interfaces, and the like are contemplated. However, other interfaces may be implemented, without departing from the scope of the technology. In addition, various high-speed interfaces may be provided such as fast token ring interfaces, wireless interfaces, Ethernet interfaces, Gigabit Ethernet interfaces, ATM interfaces, HSSI interfaces, POS interfaces, FDDI interfaces and the like. Generally, these interfaces may include ports appropriate for communication with the appropriate media. In some cases, they may also include an independent processor and, in some instances, volatile RAM.

Although the system shown in FIG. 8 is one example of a processing-device that can be used to facilitate the implementation of various aspects of the disclosed invention, it is by no means the only device architecture on which the present invention can be implemented. Regardless of the device's configuration, it can employ one or more memories or memory modules (including memory 861) configured to store program instructions for the general-purpose network operations and mechanisms for roaming, route optimization and routing functions described herein. The program instructions may control the operation of an operating system and/or one or more applications, for example.

It is understood that some of the described features and applications can be implemented as software processes that are specified as a set of instructions recorded on a computer-readable storage medium (also referred to as non-transitory computer-readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, EEPROMS, flash memory, SD-Cards etc. The computer readable media does not include carrier waves and electronic signals passing wirelessly or over wired connections.

In this specification, the term "software" includes firmware residing in read-only memory or applications stored in magnetic storage that can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program may be executed by a general-purpose processor, a digital signal processor, or describe a particular hardware configuration (such as VHDL and Verilog) to synthesize and execute the program on an ASIC, FPGA or other programmable hardware. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

An array system of the subject technology may include various types of computer readable media and interfaces for various other types of computer readable media. One or more components of the platform may include a bus, processing unit(s), a system memory, a read-only memory (ROM), a permanent storage device, an input device interface, an output device interface that is configured to generate a graphical image.

The bus may collectively represent all system, peripheral, and chipset buses that communicatively connect the numerous internal devices of the platform. For instance, the bus may communicatively connect processing unit(s) with ROM, system memory, and permanent storage device.

From these various memory units, processing unit(s) retrieves instructions to execute and data to process in order to execute the processes of the subject disclosure. The processing unit(s) can be a single processor or a multi-core processor in different implementations.

ROM stores static data and instructions that are needed by processing unit(s) and other modules of the array system. Permanent storage device, on the other hand, is a read-and-write memory device. This device is a non-volatile memory unit that stores instructions and data even when the platform is off. Some implementations of the subject disclosure use a mass-storage device (such as a magnetic or optical disk and its corresponding disk drive) as permanent storage device.

Other implementations use a removable storage device (such as a floppy disk, flash drive, and its corresponding disk drive) as permanent storage device. Like permanent storage device, system memory is a read-and-write memory device. However, unlike storage device, system memory is a volatile read-and-write memory, such a random access memory. System memory stores some of the instructions and data that the processor needs at runtime. In some implementations, the processes of the subject disclosure are stored in system memory, permanent storage device, and/or ROM. For example, the various memory units include instructions for generating a graphical image, or processing data in accordance with some implementations. From these various memory units, processing unit(s) retrieves instructions to execute and data to process in order to execute the processes of some implementations.

Bus also connects to input and output device interfaces and. Input device interface enables a user to communicate information and select commands to the array system. Input devices used with input device interface include, for example, alphanumeric keyboards and pointing devices (also called "cursor control devices"). Output device interfaces enables, for example, the display of images generated by the array system. Output devices used with output device interface include, for example, display devices, such as cathode ray tubes (CRT) or liquid crystal displays (LCD), specialized hardware such as heads up displays (HUDs), wearable display technologies, and other specialized display technologies. Some implementations include devices such as a touch screen that functions as both input and output devices.

These functions described above can be implemented in digital electronic circuitry, in computer software, firmware or hardware. The techniques can be implemented using one or more computer program products. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable discs, ultra-density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

Embodiments of the subject matter described in this specification can be implemented in a computing system that includes a back-end component, e.g., as a data server, or that includes a middleware component, e.g., an application server, or that includes a front-end component, or any combination of one or more such back end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" or "example" is used herein to mean "serving as an example or illustration." Any aspect or design described herein as "exemplary" or "example" is not necessarily to be construed as preferred or advantageous over other aspects or designs.

Furthermore, to the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." The term "some" refers to one or more. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

Definition of Terms $\lambda$: Wavelength $\theta$: Far field location angle $\theta_d$: Steering direction $\theta_{HPBW}$: Spatial resolution of an array system AF: Array Factor is the field transmission or reception pattern that occurs (independent of wavelength) when combining sources or receivers in a coherent process.

AI: Artificial Intelligence $\omega_n$: Complex excitation coefficients d: Spacing between elements k: Wave number vector k: Wave number L: Aperture length M: Complexity Reduction Factor Mtx: Complexity Reduction Factor for transmit group Mrx: Complexity Reduction Factor for receive group N: Element number Na: Number of elements in group A (transmitter)

Nb: Number of elements in Group B (receiver)

Nc: Number of elements in a conventional array design

Nac: Number of elements in group A (transmitter) of a conventional array

Nbc: Number of elements in Group B (receiver) of a conventional array $\hat{r}$: Direction unit vector $\vec{r}_n$: Location vector of the elements Sa: Inter-element spacing in Group A (transmitter)

Sb: Inter-element spacing in Group B (receiver)

What is claimed is:

1. An active array system, comprising:

one or more processors; and a plurality of radiating elements coupled to the one or more processors, wherein the plurality of radiating elements comprise:

a first group of radiating elements comprising a first number of radiating elements (Na) disposed a first distance apart (Sa); and a second group of radiating elements comprising a second number of radiating elements (Nb) disposed a second distance apart (Sb);

wherein the second number of radiating elements (Nb) are configured to form an aperture spanning a length (L), and wherein the second distance (Sb) is based on a reduction factor (Mrx), the first number of radiating elements (Na), and the first distance (Sa).

2. The active array system of claim 1, wherein the first number of radiating elements (Na) is less than the second number of radiating elements (Nb).

3. The active array system of claim 1, wherein Sb is greater than one-half of a wavelength of a transmit signal associated with the first group radiating elements (Na).

4. The active array system of claim 1, where in the one or more processors are configured to process a radiation pattern comprising a plurality of lobes, and to identify a primary lobe from among the plurality of lobes for signal processing.

5. The active array system of claim 1, wherein the second group of radiating elements are configured to operate above 10 GHz.

6. The active array system of claim 1, wherein the second group of radiating elements are configured to operate between 30 GHz and 300 GHz.

7. The active array system of claim 1, wherein the first group of radiating elements (Na) are configured to operate at wavelengths between 1 mm and 1 cm.

8. A method comprising:

transmitting a first radiation pattern using a first group of radiating elements, wherein the first group of radiating elements comprise a first number of radiating elements (Na) disposed a first distance apart (Sa); and receiving a second radiation pattern using a second group of radiating elements, wherein the second group of radiating elements comprise a second number of radiating elements (Nb) disposed a second distance apart (Sb), wherein the second number of radiating elements (Nb) are configured to form an aperture spanning a length (L), and wherein the second distance (Sb) is based on a reduction factor (Mrx), the first number of radiating elements (Na), and the first distance (Sa).

9. The method of claim 8, wherein the first number of radiating elements (Na) is less than the second number of radiating elements (Nb).

10. The method of claim 8, wherein Sb is greater than one-half of a wavelength of a transmit signal associated with the first group of radiating elements (Na).

11. The method of claim 8, further comprising:

processing a radiation pattern comprising a plurality of lobes, and to identify a primary lobe from among the plurality of lobes for signal processing.

12. The method of claim 8, wherein the second group of radiating elements are configured to operate above 10 GHz.

13. The method of claim 8, wherein the second group of radiating elements are configured to operate between 30 GHz and 300 GHz.

14. The method of claim 8, wherein the first group of radiating elements (Na) are configured to operate at wavelengths between 1 mm and 1 cm.

15. A non-transitory computer-readable storage medium comprising instructions stored therein, which when executed by one or more processors, cause the processors to perform operations comprising:

transmitting a first radiation pattern using a first group of radiating elements, wherein the first group of radiating elements comprise a first number of radiating elements (Na) disposed a first distance apart (Sa); and receiving a second radiation pattern using a second group of radiating elements, wherein the second group of radiating elements comprise a second number of radiating elements (Nb) disposed a second distance apart (Sb), wherein the second number of radiating elements (Nb) are configured to form an aperture spanning a length (L), and wherein the second distance (Sb) is based on a reduction factor (Mrx), the first number of radiating elements (Na), and the first distance (Sa).

16. The non-transitory computer-readable storage medium of claim 15, wherein the first number of radiating elements (Na) is less than the second number of radiating elements (Nb).

17. The non-transitory computer-readable storage medium of claim 15, wherein Sb is greater than one-half of a wavelength of a transmit signal associated with the first group of radiating elements (Na).

18. The non-transitory computer-readable storage medium of claim 15, where in the one or more processors are configured to process a radiation pattern comprising a plurality of lobes, and to identify a primary lobe from among the plurality of lobes for signal processing.

19. The non-transitory computer-readable storage medium of claim 15, wherein the second group of radiating elements are configured to operate above 10 GHz.

20. The non-transitory computer-readable storage medium of claim 15, wherein the second group of radiating elements are configured to operate between 30 GHz and 300 GHz.

* * * * *